US009859074B1

(12) United States Patent
Martinez

(10) Patent No.: US 9,859,074 B1
(45) Date of Patent: Jan. 2, 2018

(54) LOCKING DEVICE FOR ROCKER SWITCH

(71) Applicant: Carlos M. Martinez, Nanuet, NY (US)

(72) Inventor: Carlos M. Martinez, Nanuet, NY (US)

( * ) Notice: Subject to any disclaimer, the term of this patent is extended or adjusted under 35 U.S.C. 154(b) by 0 days.

(21) Appl. No.: 15/694,812

(22) Filed: Sep. 3, 2017

(51) Int. Cl.
*H01H 9/28* (2006.01)
*H01H 23/04* (2006.01)
*H01H 3/20* (2006.01)

(52) U.S. Cl.
CPC ..... *H01H 23/04* (2013.01); *H01H 3/20* (2013.01); *H01H 9/28* (2013.01); *H01H 9/282* (2013.01); *H01H 9/283* (2013.01)

(58) Field of Classification Search
CPC H01H 3/20; H01H 9/28; H01H 9/282; H01H 9/283
USPC ..... 200/43.16, 43.01, 43.11
See application file for complete search history.

(56) References Cited

U.S. PATENT DOCUMENTS

| | | | |
|---|---|---|---|
| 2,300,102 | A | 10/1942 | Christensen |
| 2,523,943 | A | 9/1950 | Choppa |
| 2,789,170 | A | 4/1957 | Johnson |
| 4,187,420 | A | 2/1980 | Piber |
| 4,876,425 | A | 10/1989 | Woskow |
| 4,910,365 | A | 3/1990 | Kuo |
| 5,290,979 | A | 3/1994 | Grass |
| 5,468,925 | A | 11/1995 | Mohsen |
| 5,723,833 | A | 3/1998 | Thrasher |
| 6,259,047 | B1 | 7/2001 | Kimata et al. |
| 6,392,170 | B1 | 5/2002 | Wechsler |
| 6,472,619 | B1 | 10/2002 | Halphide |
| 6,759,609 | B1 | 1/2004 | Henderson et al. |
| 9,230,767 | B2 | 1/2016 | Bunk et al. |
| 9,466,440 | B2 | 10/2016 | Sonobe |
| 2003/0057065 | A1 | 3/2003 | Hecker |
| 2005/0194243 | A1 | 9/2005 | Prineppi |

FOREIGN PATENT DOCUMENTS

| | | | |
|---|---|---|---|
| FR | 2667719 | A1 | 4/1992 |
| FR | 2861213 | A1 | 4/2005 |
| JP | 61116723 | A | 6/1986 |
| JP | 2001084858 | A | 3/2001 |
| JP | 2009289643 | A | 5/2013 |

*Primary Examiner* — Vanessa Girardi
(74) *Attorney, Agent, or Firm* — Michael E. Zall

(57) ABSTRACT

A locking device for a rocker switch that has an elongated member having a top edge, a bottom edge, opposite ends, a front facing surface and a rear facing surface. A toggle member is pivotally mounted to the front facing surface. The toggle member pivots between a first toggle position that extends below the bottom edge of the elongated member and a second toggle position that does not extend below the bottom edge. The rear facing surface of the elongated member is mounted to the switch plate cover, the bottom edge of the elongated member adjacent the first end of the rocker switch. When the first end of the rocker switch is pivoted to the first position the toggle may be pivoted to the first toggle position to extend below the lower edge of the elongated member to overlie the first end of the rocker switch to lock the rocker switch in the first position. The toggle may be pivoted to the second toggle position to unlock the rocker switch from the first position. A locking device may be provided for each end of the rocker switch. Locking devices built into the ends of the rocker switch are also described.

9 Claims, 17 Drawing Sheets

LOCKING DEVICE FOR ROCKER SWITCH

FIELD OF THE INVENTION

This invention relates to a rocker switches of the type which are typically wall-mounted and are used to turn on and off for example, electric lights. In particular, this invention relates to a safety device either added as an accessory or built into a rocker switch to prevent the erroneous switching of the rocker switch from one position, e.g., "on" to a second position, e.g., "off".

BACKGROUND OF THE INVENTION

Electrical circuits in residential and commercial buildings are often controlled by rocker switches. A rocker switch is typically surrounded by a switch plate cover. The rocker switch has opposite ends that are pivotable about a pivot axis between the ends. The rocker switch is movable between a first position, e.g., "on" wherein the first end is substantially flush with a first portion of the switch plate and a second position, e.g., "off" wherein the second end is substantially flush with a second portion of the switch plate. The rocker switch when used in a conventional manner may be accidentally depressed to turn on a light, activate an alarm or even injure someone working on the electrical system.

In certain applications, it is desirable to provide a means for preventing the rocker switch from being moved from an "on" position to an "off" position or vice versa. In some situations it may be desirable to have an electric circuit that is always open and in other situations, it is desirable to have an electric circuit that is always closed.

It is often necessary that motors for equipment, such as garbage disposals, overhead heat lamps, bathroom fans, pumps and the like are not turned "on" or "off" accidentally. In some cases, such as for a refrigerator or a water pump connected to a switch, it is desired to have the switch in the "on" position and it is not desired that the switch be accidentally turned "off". In another example, in a photographic darkroom it is desirable to have the electric light off so as not to interfere with the processing the film. It is thus desirable to have a lock on the rocker switch to ensure that the switch is not inadvertently turned on. In most cases, there are no labels placed on the individual switches so that it may be difficult to know if the device is on or off.

The rocker switch may be located close to the load, e.g., light, pump, computer, controlled by the switch, or may be significantly remotely located from such a load. When an electrician or other worker performing operations on the load or on the load side of the electric circuit thereof safety requires that the switch controlling that circuit be in an "off" position and maintained in the "off" position. Inadvertent activation of the switch to its "on" position while work is being performed on the load side of the circuit can cause injury to the worker and damage to the circuit and load equipment. Thus, the switch needs to be securely maintained in its "off" position while the work is being performed. Although not as dangerous, the accidental switching of, for example lights to the on position when not desired can increase the cost and waste electrical energy.

There have been many different types of devices to lock electrical switches in a selected "on" or "off" position. In its simplest form a lock can be adhesive tape placed over the switch to maintain the switch in the desired position. However, this requires that the tape be removed when it is desired to move the switch and replaced when needed. Other type locking devices are usually complicated, inconvenient, built into the switch and are expensive.

The following references may be relevant to this invention:

US Publication No. 2003/0057065 A1 to Hecker
US Publication No. 2005/0194243 to Prineappi
U.S. Pat. No. 2,300,102 to Christensen
U.S. Pat. No. 2,523,943 to Choppa
U.S. Pat. No. 2,789,170 to Johnson
U.S. Pat. No. 4,187,420 to Piber
U.S. Pat. No. 4,876,425 to Woskow
U.S. Pat. No. 4,910,365 to Kuo
U.S. Pat. No. 5,290,979 to Grass
U.S. Pat. No. 5,468,925 to Mohsen
U.S. Pat. No. 5,723,833 to Thrasher
U.S. Pat. No. 6,259,047 to Kimata et al.
U.S. Pat. No. 6,392,170 to Wechsler
U.S. Pat. No. 6,472,619 to Halphide
U.S. Pat. No. 6,759,609 to Henderson et al.
U.S. Pat. No. 9,230,767 to Bunk et al.
U.S. Pat. No. 9,466,440 to Sonobe
FR 2667719 A1
FR 2861213 A1
JP 2001084858 A
JP 2009289643 A
JP 61116723 A

OBJECTS AND SUMMARY OF THE INVENTION

In view of the foregoing an object of the present invention is to provide a locking device for a rocker switch which is inexpensive and easy to use and which provides a positive lock.

It is a further object of this invention to provide a selective lockout means for rocker switches.

Another object is to provide an inexpensive add-on attachment for the rocker switch which enables a selective lockout function without altering the existing structure of the rocker switch.

Another object of the present invention is to provide a rocker switch locking device which can be easily retrofitted on the standard rocker switch either on one end of the switch or both to prevent the inadvertent switching the power on or off.

It is a further object of this invention to provide a rocker switch that has built into one end of the rocker switch or both ends of the rocker switch a locking means that is simple and easy to activate to prevent the inadvertent switching of the power on or off.

Referring to FIGS. 1-14 herein, an embodiment of this invention is directed to a combination rocker switch and an "after-market" locking device for the rocker switch. The rocker switch extends from a switch plate cover, the rocker switch having opposite first and second ends pivotable about a pivot axis between the first and second ends. The rocker switch is movable between a first position wherein the first end is substantially flush with a first portion of the plate and a second position wherein the second end is substantially flush with a second portion of the plate.

The locking device comprises:

i. an elongated member having a top edge, a bottom edge, opposite ends, a front facing surface and a rear facing surface;

ii. a toggle member pivotally mounted to the front facing surface, the toggle member pivotable between a first toggle position that extends below the bottom edge of the elongated member and a second toggle position that does not extend below the bottom edge.

The rear facing surface of the elongated member is mounted to the switch plate on the first portion of the plate, preferably by a pressure sensitive adhesive layer over a portion of the rear facing surface. The bottom edge of the elongated member is adjacent the first end of the rocker switch.

When the first end of the rocker switch is pivoted to the first position and is substantially flush with the first portion of the plate, the toggle may be pivoted to the first toggle position to extend below the lower edge of the elongated member to overlie the first end of the rocker switch to lock the rocker switch in the first position and the toggle may be pivoted to the second toggle position to unlock the rocker switch from the first position, see, for example FIG. 3.

Optionally, a second locking device may be mounted on the switch plate for use at the second end of the rocker switch to enable the locking of the rocker switch in the first and second position.

Referring to FIGS. 15-23 herein, another embodiment of a combination rocker switch and locking device is depicted wherein the locking device is "built-in" to the rocker switch. In this embodiment the rocker switch extends from a switch plate cover, the rocker switch having opposite first and second ends, the first end having a first end face and the second end having a second end face. The rocker switch is pivotable about a pivot axis between the first and second ends, the rocker switch being movable between i) a first position wherein the first end is substantially flush with a first portion of the plate and the second end and second end face project above the second portion of the plate, and ii) a second position wherein the second end is substantially flush with the second portion of the plate and the first end and first end face project above the first portion of the plate. A locking button having a first button end and a second button end is provided. The first button end is mounted within the first end of the rocker switch in the first end face. The locking button can be selectively positioned to have the second button end project above the first end face or positioned flush with the first end face. When the first locking button is selectively positioned to have the second button end flush with the first end face, the rocker switch may pivoted to the first position wherein the first end is substantially flush with a first portion of the plate. However, when the rocker switch is pivoted to the second position wherein the second end is substantially flush with the second portion, and the locking button in the first end of the rocker switch may be selectively positioned to have the second button end project above the first end face locking the rocker switch in the second position, see for example, FIGS. 16 & 18.

Thus, the invention described and claimed herein, provides a locking device for a rocker switch which is inexpensive, easy to use, provides a positive lock for the switch, can be selectively used when desired, may be an add-on attachment for the switch without altering the existing structure of the switch, may be installed on one or both ends of the switch or may be built into one or both ends of the rocker switch.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

Further aspects, features and advantages of the present invention will become even more apparent with reference to the following detailed description and the accompanying drawings.

"After Market" Locking Device for Rocker Switch

"Built-In" Locking Device for Rocker Switch

Figure 15:
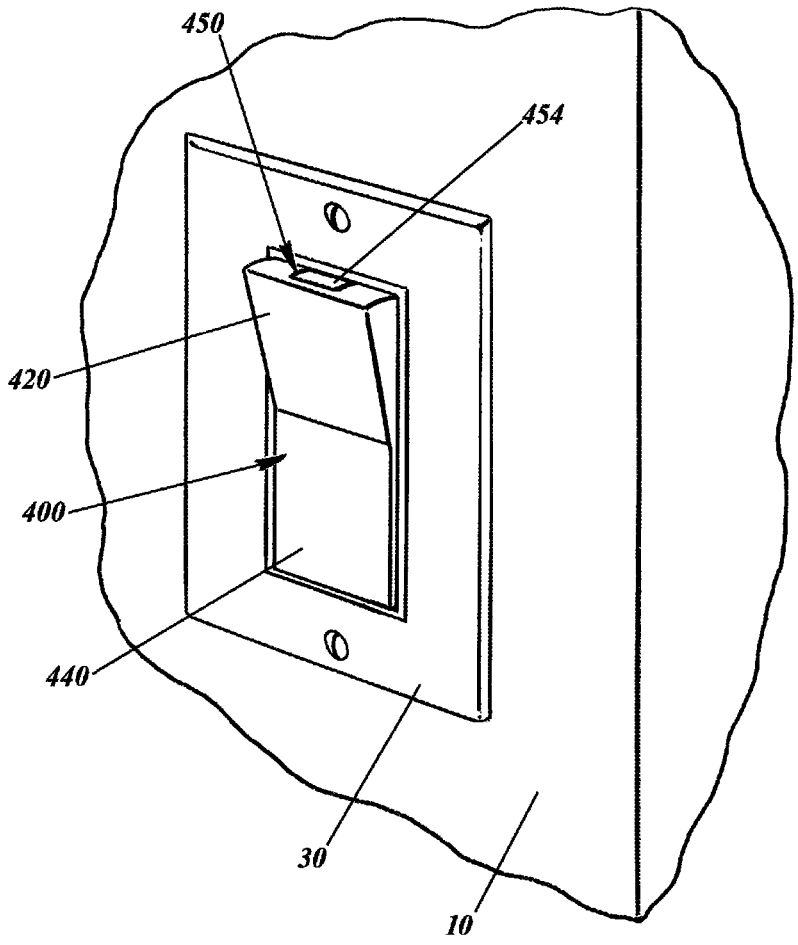
Figure 16:
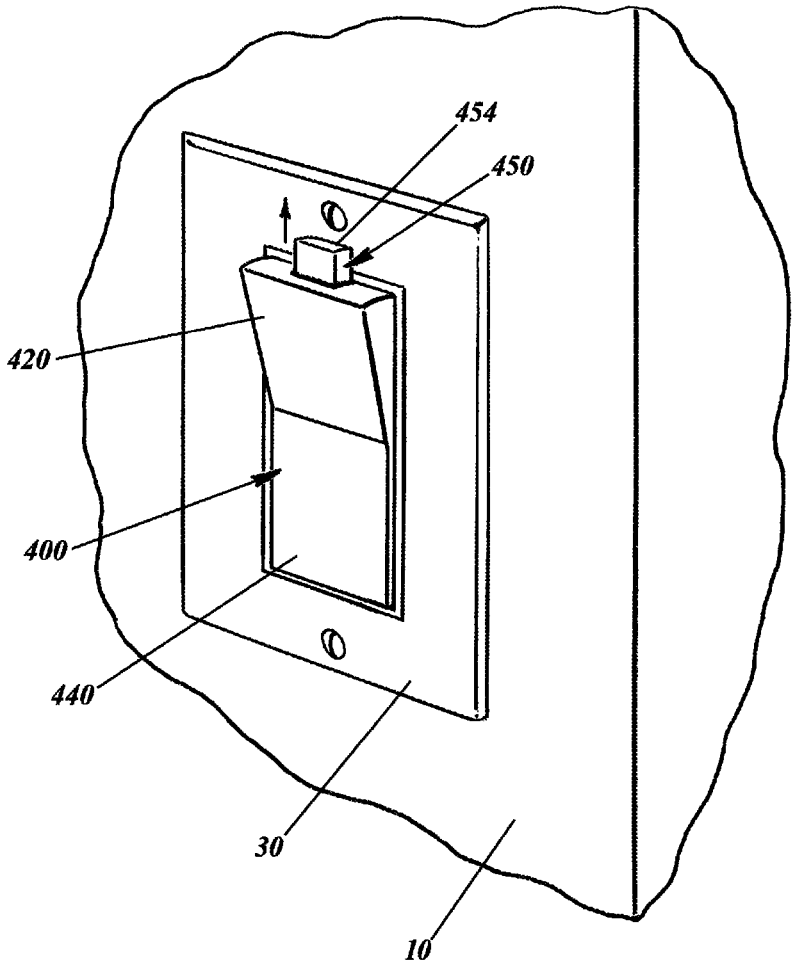
Figure 17:
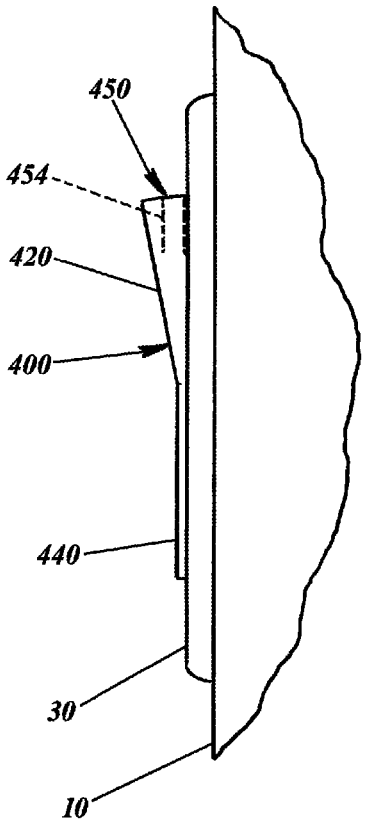
Figure 18:
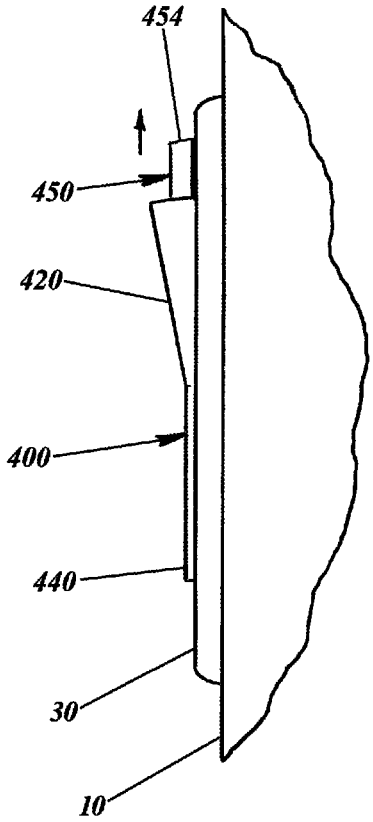
Figure 19:
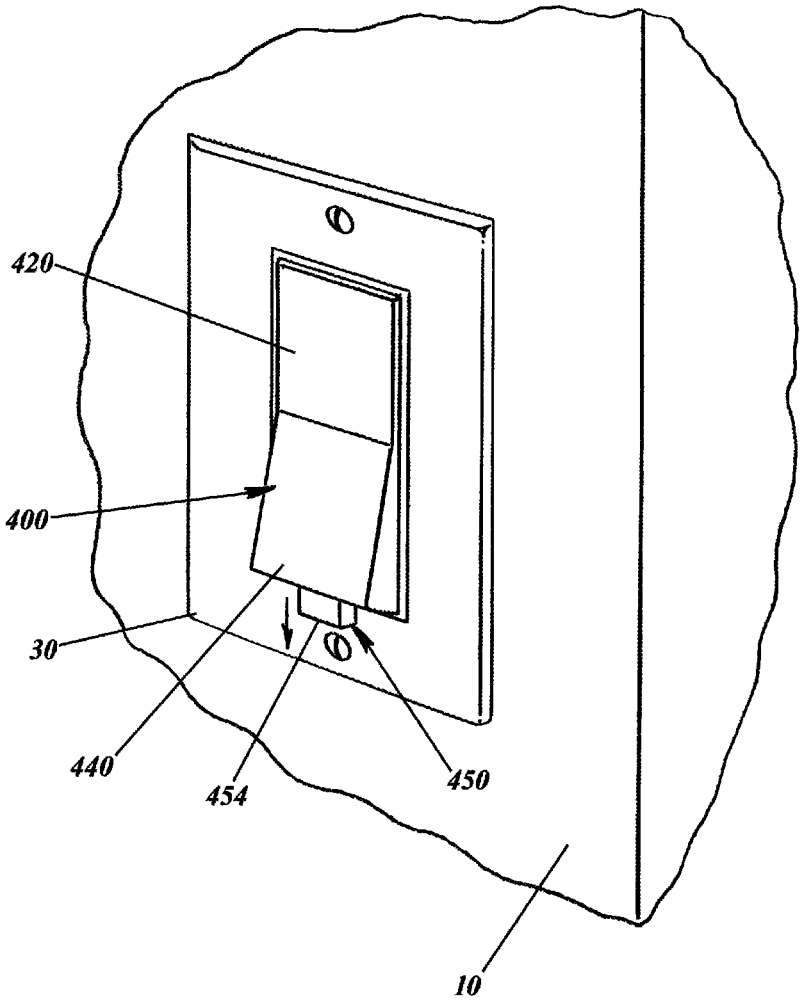
Figure 20:
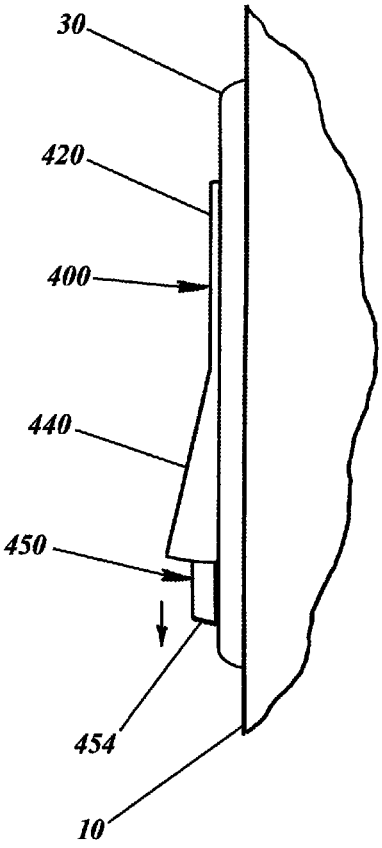
Figure 21:
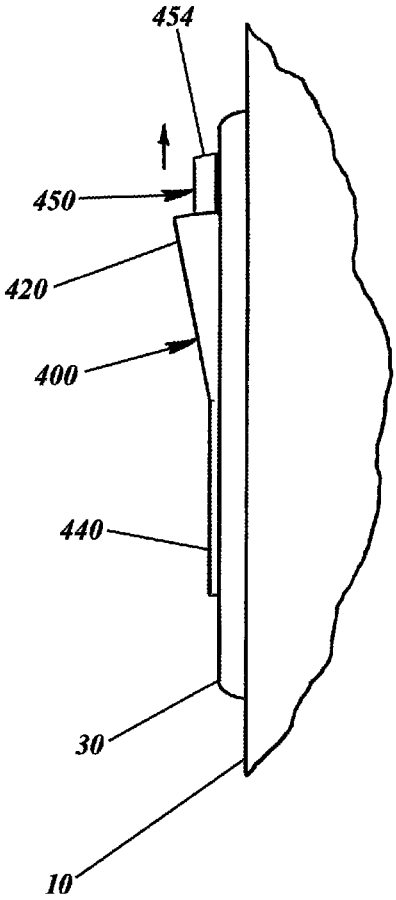
Figure 22:
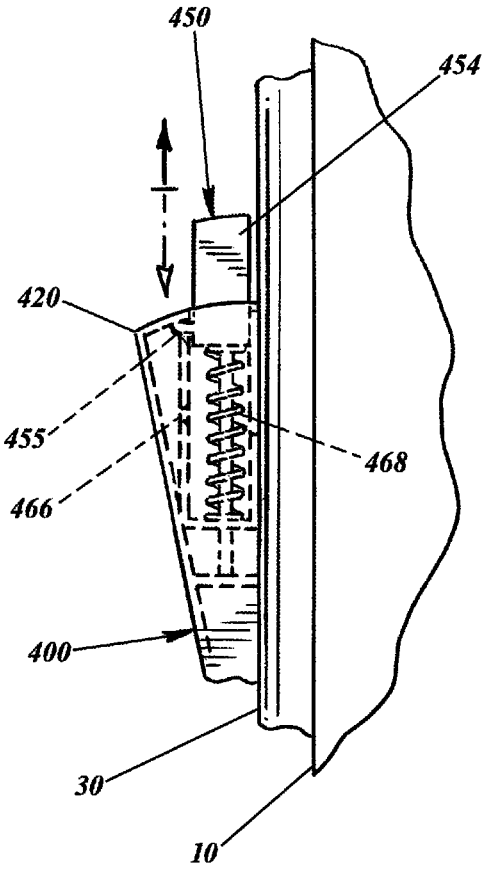
Figure 23:
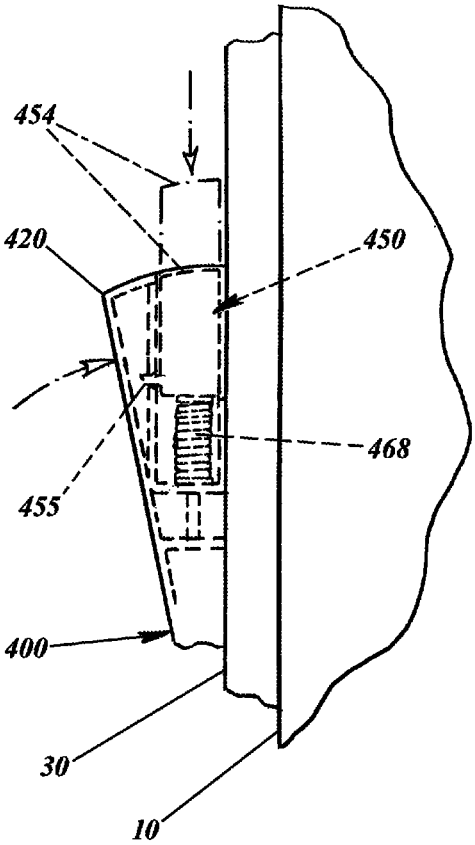

FIG. 15 is a perspective view of a further embodiment of the locking device of the present invention wherein a push-button mechanism allows for engagement or disengagement of the lock and is shown in a disengaged (unlocked) position;

FIG. 16 is a view similar to FIG. 15 wherein the push-button mechanism is shown in an extended and engaged (locked) position;

FIGS. 17 and 18 are right side views of FIGS. 15 and 16 respectively;

FIG. 19 is a perspective view utilizing the locking device of FIG. 15 and is located on the opposite side of the rocker switch and is shown in an engaged (locked) position;

FIGS. 20 and 21 depict an embodiment wherein the push-button mechanism is utilized on both ends of the rocker switch allowing for the engagement (locked) or disengagement (unlocked) of the locking device; and FIGS. 22 and 23 are detail views illustrating how the push-button locking device may be implemented The drawings are not presented to scale but are only used to illustrate the principles of the invention. In the drawings, like reference numbers indicate like elements.

DETAILED DESCRIPTION OF THE INVENTION

A detailed description of one or more embodiments is provided below along with accompanying Figures that illustrate the principles of the embodiments. The scope of the embodiments is limited only by the claims and encompasses numerous alternatives, modifications and equivalents. Numerous specific details are set forth in the following description. These details are provided solely for the purposes of example and the embodiments may be practiced according to the claims without some or all of these specific details.

Referring now to the drawings, in which like numerals represent like elements throughout the several views.

FIGS. 1 through 6 illustrate a first embodiment of the locking device 50 of this invention installed on an existing rocker switch 40. It should be noted that although a standard vertical rocker wall switch 40 is shown, the same type of locking device 50 could be adapted for usage with other types of rocker switches such as horizontally disposed rocker switches and groups of switches.

Figure 1:
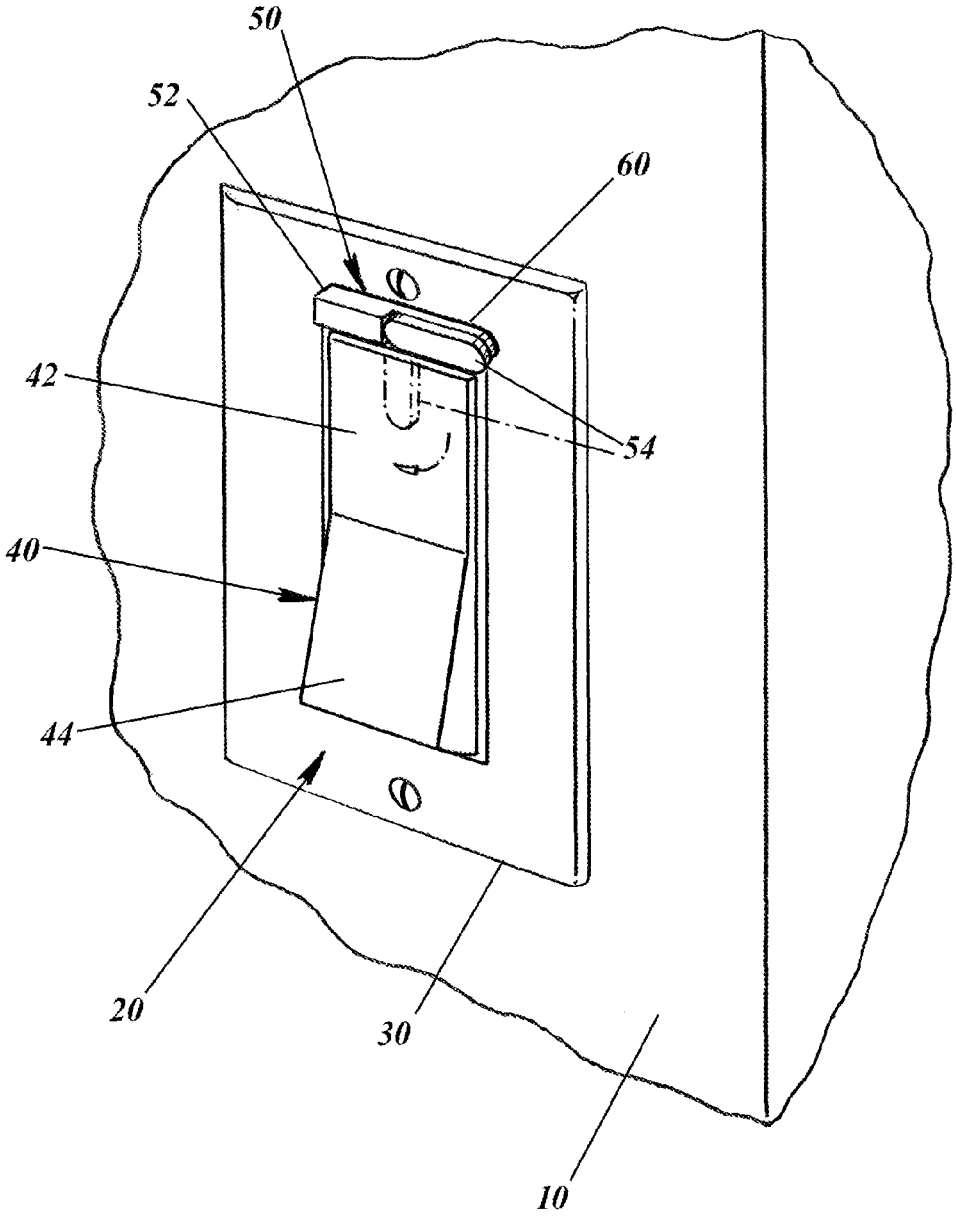
FIG. 1 is a perspective view of a vertically actuated conventional rocker style switch along with the an embodiment the locking device of this invention installed thereon.
Figure 2:
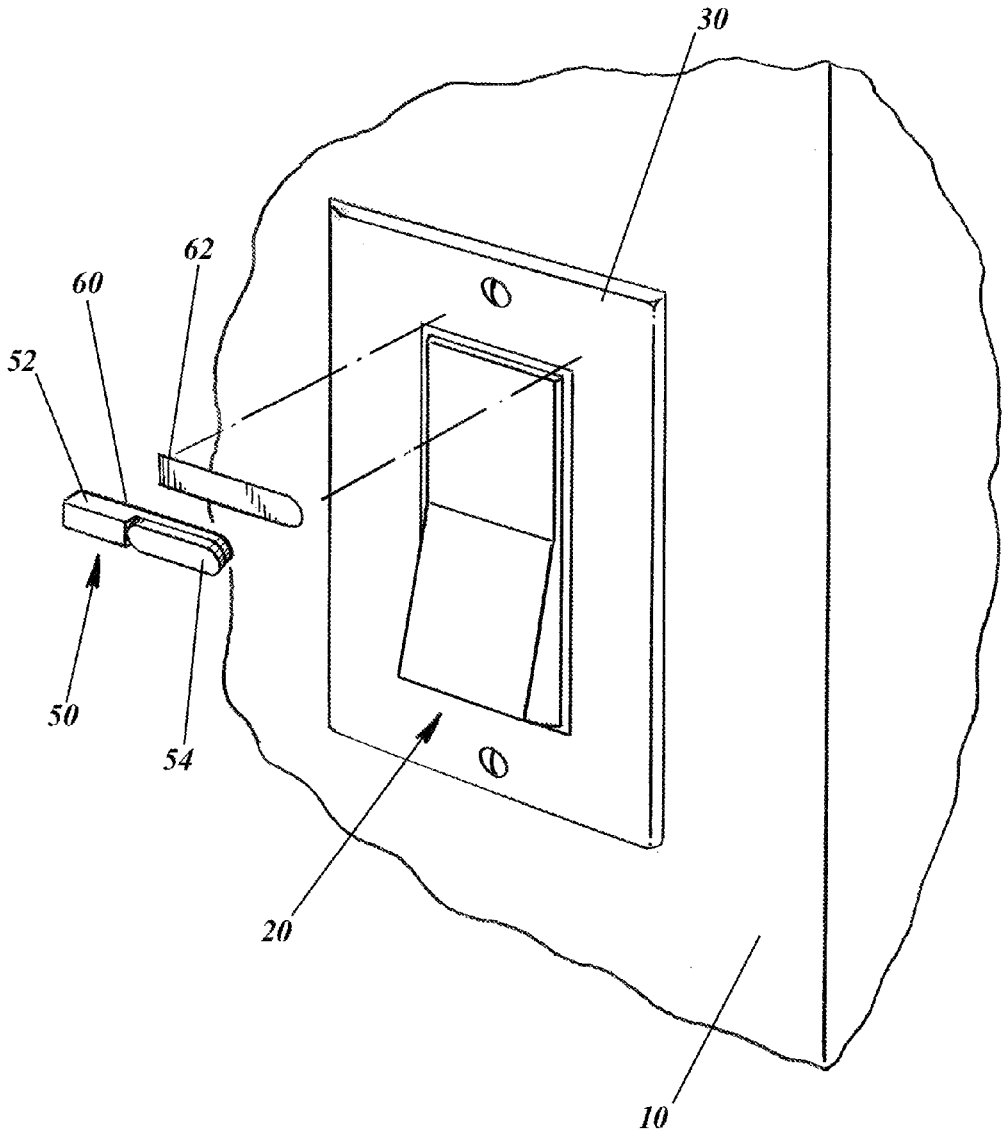
FIG. 2 is an exploded perspective view of FIG. 1 showing the locking device prior to affixing to it the switch cover plate of FIG. 1.

Additionally, the following description will make reference to the positions of the rocker switch as being either "On" or "Of" wherein the conventional practice for different countries varies. For example the position of the rocker switch in FIG. 1 is in the "On" position for most countries including the USA; however in Great Britain it would be considered to be in the "Off" position. The execution of the present invention can be carried out regardless of the orientation of the existing rocker switch. As used herein, these can be referred to as a "first position" and a "second position" without any relevance to being "On" or "Off."

Figure 3:
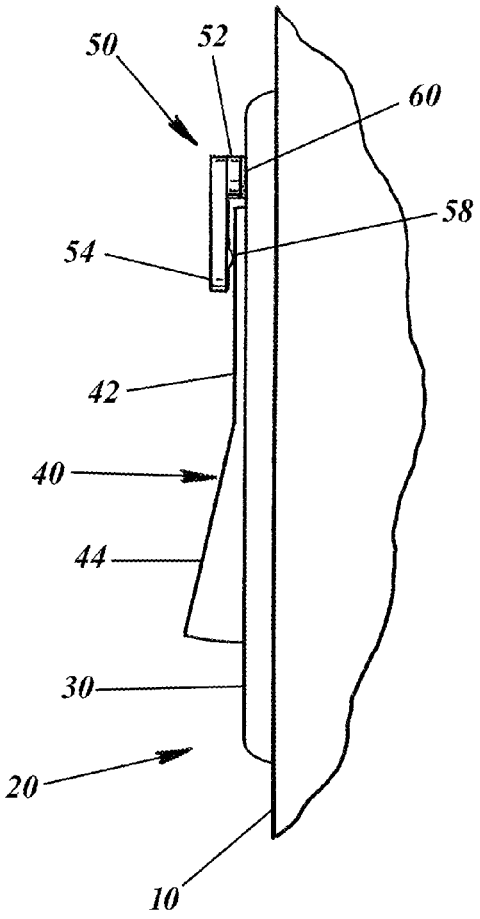
FIG. 3 is a right side view of the rocker style switch and locking device shown in FIG. 1 wherein the device is shown moved into an engaged (locked) position preventing the movement of the switch.

Referring to FIGS. 1-6, broadly the rocker switch 40 extends from a switch plate cover 30, the rocker switch 40 has opposite first 42 and second 44 ends pivotable about a pivot axis between the first and second ends 42, 44. Referring, for example, to FIG. 3, the rocker switch 40 is movable between i) a first position ("On") wherein the first end 42 is substantially or almost flush with a first portion of the switch plate cover 30, and ii) (referring to FIG. 4) a second position wherein the second end 44 is substantially or almost flush with a second portion of the switch plate cover 30, a conventional rocker wall switch 20 is mounted within wall 10. Switch 20 is comprised of a switch plate cover 30 and rocker switch 40.

The rocker switch 40 has upper portion 42 and lower portion 44 that serve to actuate the switch in an On/Off manner. Referring to FIGS. 1-6, locking device 50 is adjacent the upper edge of upper portion 42 and is mounted to or can be made as a part of the switch plate cover 30. Locking device 50 has an elongated stationary portion 52 and a toggle portion 54 pivotally mounted to the elongated stationary portion 52. In one embodiment, as can best be seen in FIGS. 1 and 2 the locking device 50 is mounted to switch plate cover 30 by removing a release liner 62 which exposes a pressure sensitive adhesive layer 60 allowing the user to press the locking device 50 onto the switch plate cover 30 adjacent the upper edge of upper portion 42. The locking device 50 can alternatively be mounted at the lower portion 44 depending on the application desired.

Referring to FIGS. 1-4, the locking device 50 includes an elongated member 52 having a top edge, a bottom edge, opposite ends, a front facing surface and a rear facing surface 60. A toggle member 54 is pivotally mounted to the front facing surface. The toggle member 54 is pivotable between a first toggle position (see FIG. 3) that extends below the bottom edge of the 15 elongated member 52 and a second toggle position (see FIG. 4) that does not extend below the bottom edge.

Figure 4:
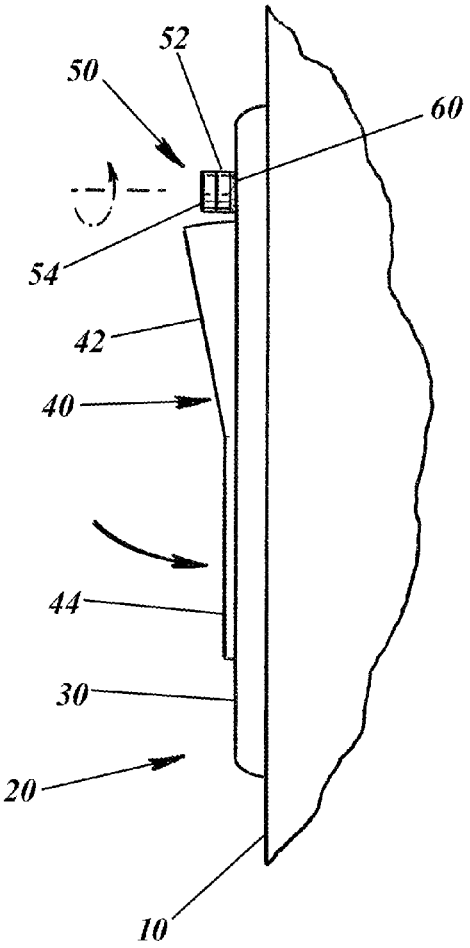
FIG. 4 is a right side view of the rocker style switch and locking device shown in FIG. 1 wherein the device is shown in a disengaged (unlocked) position allowing for movement of the switch.

FIG. 3 shows the locking device 50 and toggle 54 in a locked position which maintains the rocker switch 40 in an "On" or first position. FIG. 4 shows the rocker switch 40 turned "Off" or in the second position after returning toggle 54 to an unlocked position, i.e., a position that does not extend below the bottom edge. In this configuration the rocker switch can be used as usual until the user desires to engage the locking device 50.

Figure 5:
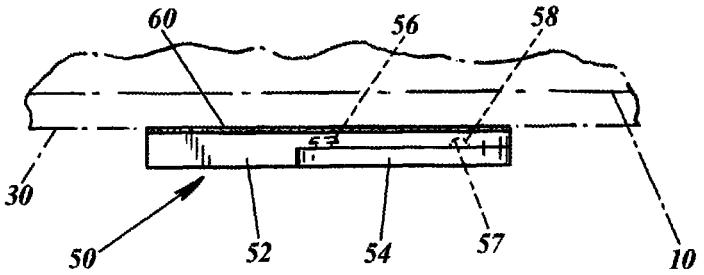
FIG. 5 is a partial top plan view of the rocker style switch and locking device shown in a disengaged (unlocked) position.
Figure 6:
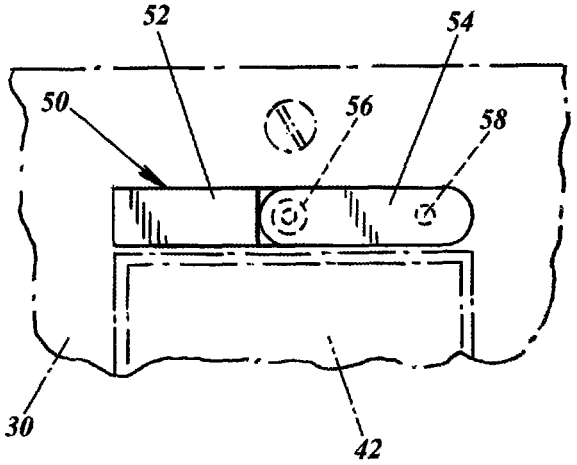
FIG. 6 is a partial front view of the rocker style switch and locking device shown in a disengaged (unlocked) position.

The manner of actuation of the locking device 50 can best be understood with reference to FIGS. 5 and 6. In the embodiment shown, toggle member 54 is attached to stationary elongated member 52 by attachment, e.g., a press fit, to pivoting post 56. Referring to FIG. 5, a small recess 57 is formed in stationary elongated member 52 to receive a domed protrusion, e.g., detent, on toggle 54 in order to assist toggle 54 to stay in an unlocked position as shown. In the locked position the toggle 54 is then rotated downward to engage the face 42 of rocker switch 40.

Figure 7:
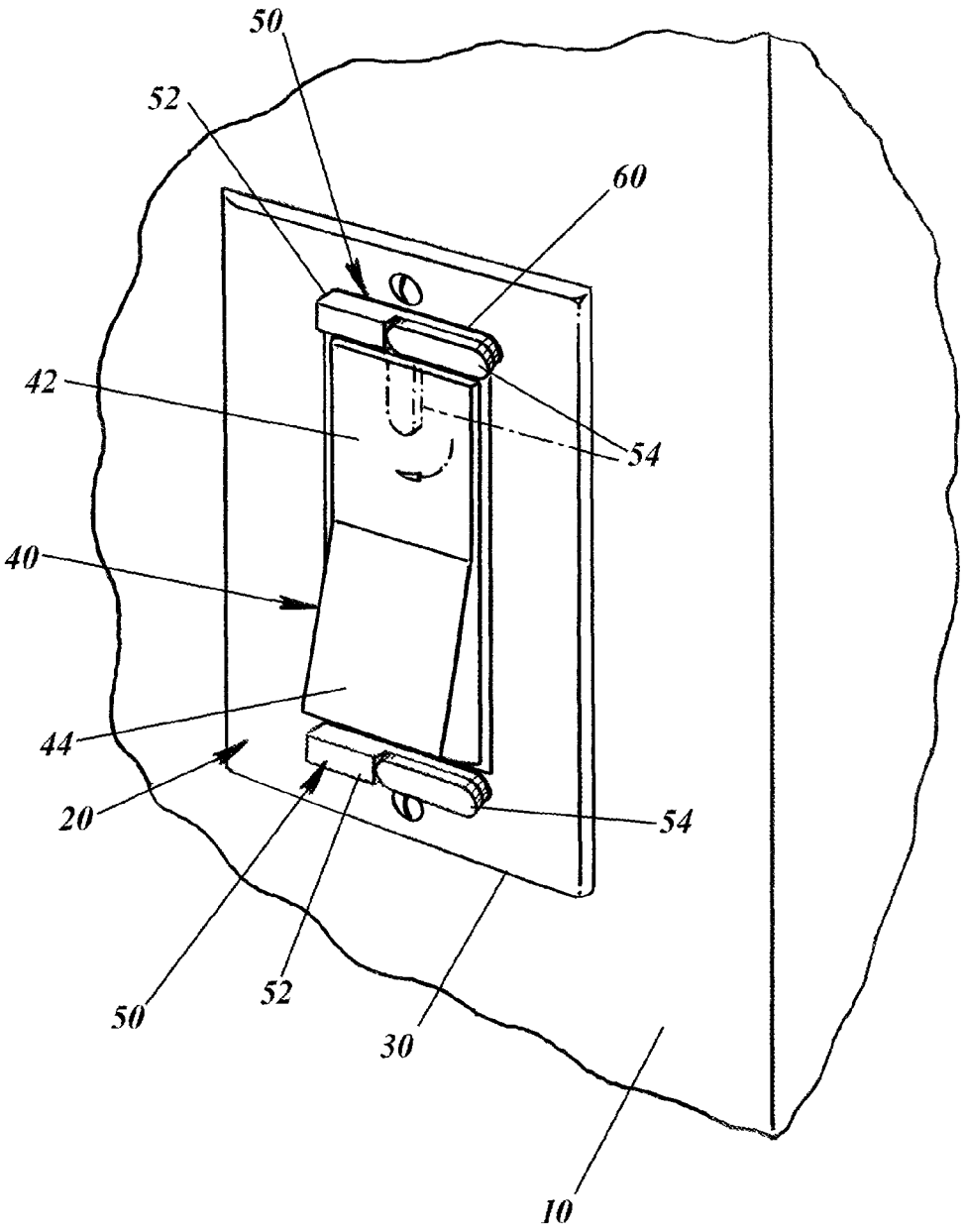
FIG. 7 is a perspective view of an embodiment similar to FIG. 1 wherein two locking devices are utilized allowing either locking device to be used in an engaged or disengaged mode to lock the rocker style switch in the on or off position.
Figure 8:
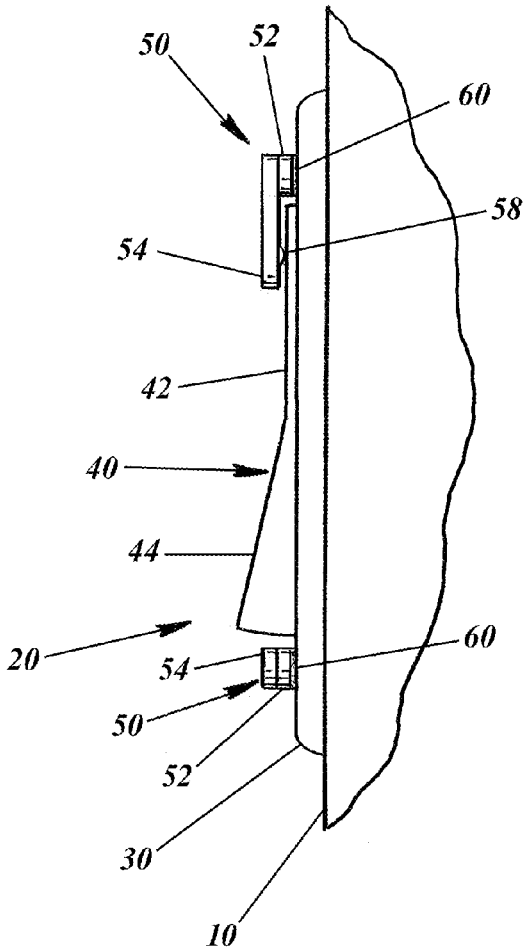
FIG. 8 is a right side view of the rocker style switch and locking devices of FIG. 7 showing the upper locking device in an engaged (locked) position and the lower locking device in a disengaged (unlocked) position.
Figure 9:
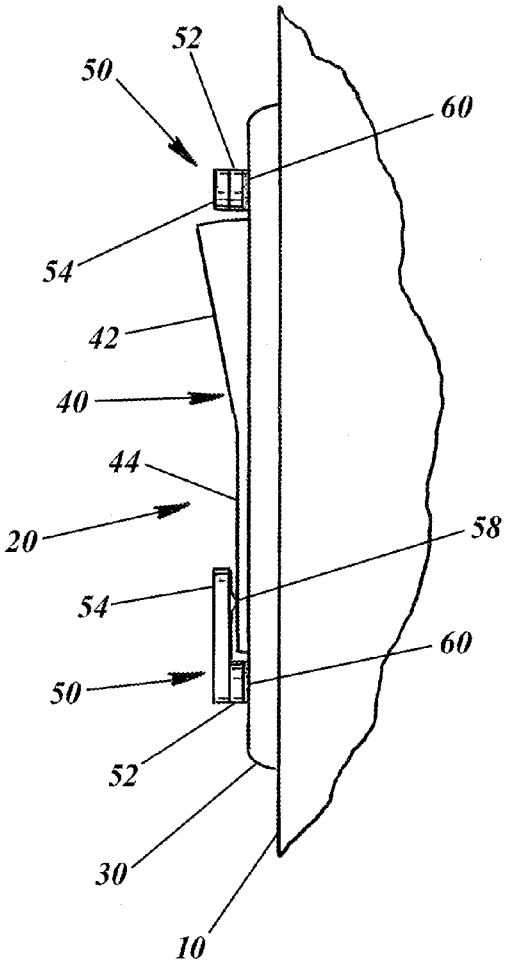
FIG. 9 is a right side view of the rocker style switch and locking devices of FIG. 7 showing the upper locking device in a disengaged (unlocked) position and the lower locking device in an engaged (locked) position.

FIGS. 7 through 9 depict another embodiment wherein two locking devices 50 are used to provide for locking the rocker switch 40 in either position. The manner of mounting the locking device 50 is the same as described for FIGS. 1 through 6.

Figure 10:
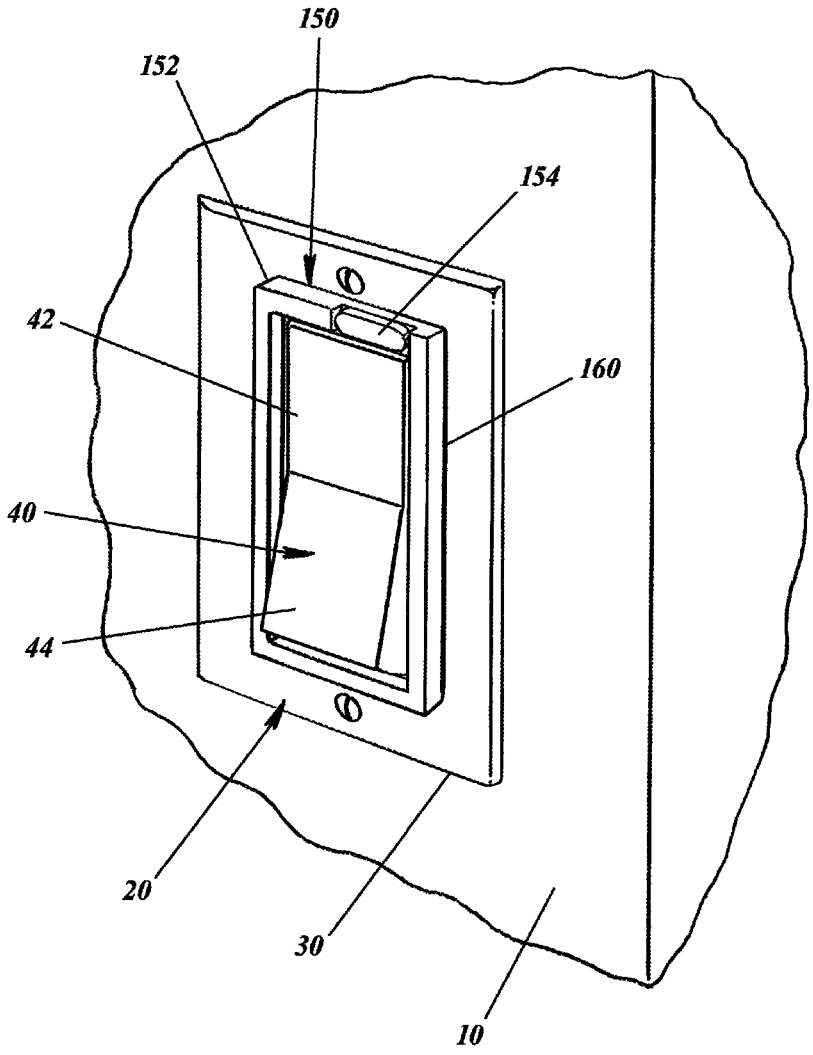
FIG. 10 is a perspective view of a further embodiment whereby the locking device is on a frame that is mounted to surround of the rocker switch, the locking device thereon being similar to that shown in FIGS. 1-9.

FIG. 10 is an embodiment whereby the locking device 150 is formed as part of a full frame 152 that surrounds the rocker switch 40 and is attached to switch plate 30 by way of pressure sensitive adhesive 160. Locking toggle 154 operates in the same fashion as previously described regarding locking toggle 54. Such a structure provides for greater integrity and optionally, a more decorative locking device 154.

Figure 11:
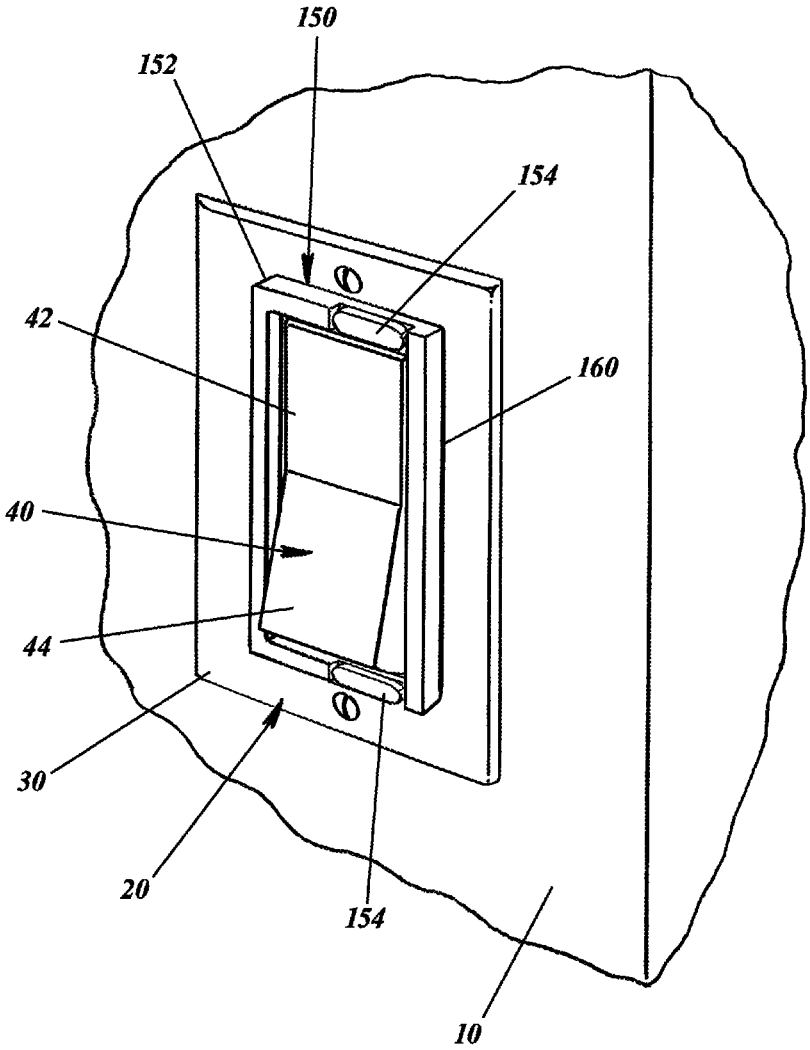
FIG. 11 is a perspective view of a further embodiment similar to FIG. 10 whereby two locking devices are part of a frame that is mounted to surround of the rocker switch utilizing two locking devices allowing for engagement (locked) or disengagement (unlocked) of either half of the switch.

FIG. 11 is a further embodiment of FIG. 10 wherein two locking devices 154 are utilized allowing for the locking of the rocker switch 40 in either position, i.e., the first position ("On") and the second position ("Off").

Figure 12:
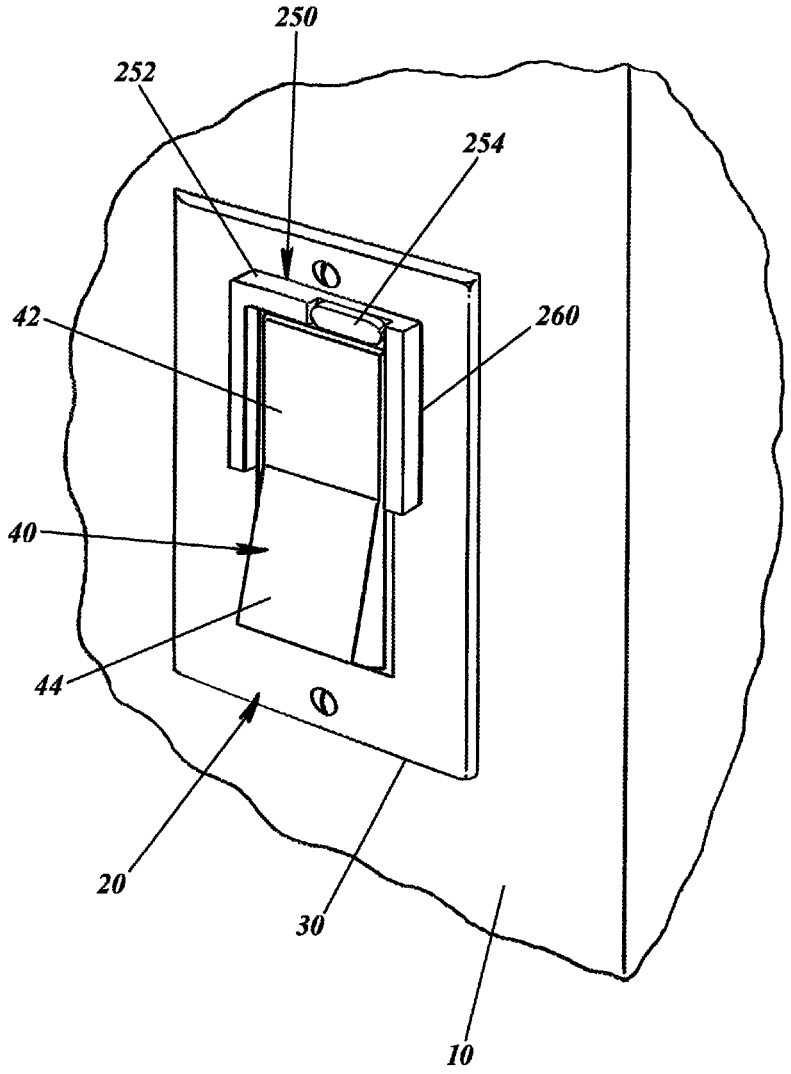
FIG. 12 is a perspective view of an additional embodiment wherein the locking device is similar to the previous embodiment and the supportive structure comprises one half of a frame that is U-shaped that surrounds the switch, wherein the locking device is on the top portion of the switch.
Figure 13:
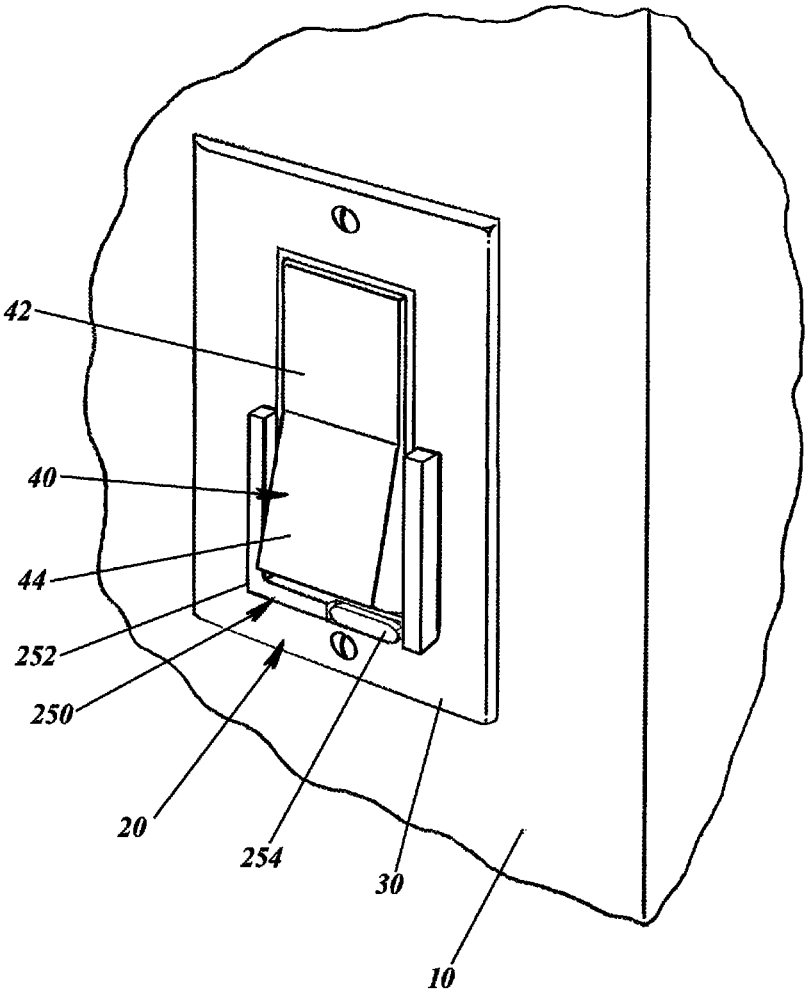
FIG. 13 is a perspective view similar to FIG. 12 wherein the locking device is similar to the previous embodiment wherein the supportive structure comprises one half of a frame that is U-shaped that surrounds the switch, wherein the locking device is on the bottom portion of the switch.

FIGS. 12 and 13 are similar to the embodiment shown in FIG. 10 but with the stationary frame portion 252 of locking device 250 covering only one half, the upper or lower portions 42 and 44 respectively, of the rocker switch 40 and is attached with pressure sensitive adhesive 260. Locking toggle 254 operates in the same fashion as in the previous description.

Figure 14:
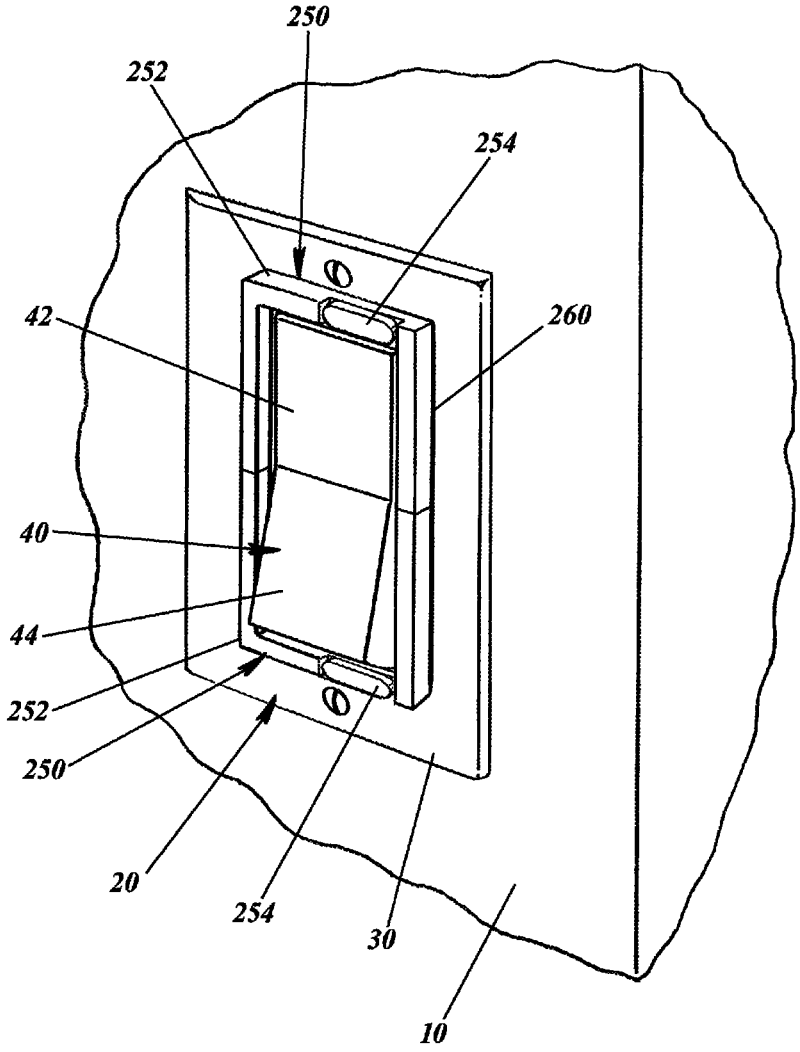
FIG. 14 shows the application of the versions shown in FIGS. 12 and 13 whereby the locking devices can both be utilized to control both halves of the switch.

FIG. 14 combines the locking elements 250 of FIGS. 12 and 13 to form locking device for both portions 42 and 44 of the rocker switch 40.

FIGS. 15 through 18 illustrate yet a further embodiment wherein the switch locking device 450 is in the form of a push button type mechanism that is formed as a part of the rocker switch 400. The switch would be a replacement or as a new installation of a rocker type wall switch 30 whereby the user desires to have the locking ability afforded by such a design. New rocker switch 400 has an upper portion 420 and a lower portion 440. Located within upper portion 420 is a locking device 450 in the form of a push button 454 that is able to be retracted flush for normal unlocked operation of the rocker switch 400 as seen in FIGS. 15 and 17. FIGS. 16 and 18 show the push button locking device 454 extended so as to prevent the rocker switch 400 from being actuated due to contact with switch plate cover 30. The details for the push button device will be described in greater detail below.

FIG. 19 is a version which has the locking device 450 within the lower portion 440 of rocker switch 400 and operates in the same manner as that described for FIGS. 15 through 18. FIG. 19 shows the push button locking device 454 extended so as to prevent the rocker switch 400 from being actuated due to contact with switch plate cover 30.

FIGS. 20 and 21 are of an embodiment that uses a locking device 450 on both the lower portions 440 and the upper portion 420 of the rocker switch 400. When the push button locking device 454 are both retracted the rocker switch 400 operates the same as a conventional rocker switch for On/Off use. When either of the locking device 450 are extended the rocker switch 400 is locked in either an "On" or "Off" position as shown in FIGS. 20 and 21, respectively.

The push button locking device 450 is best understood with reference to FIGS. 22 and 23 which show the push button locking device 454 in a first, extended and locked position along with a second, retracted and unlocked position respectively. In operation, the user presses once to extend for the button 454 and then presses again to retract the button 454. Locking device 450 is housed within rocker switch 400 and is comprised of a push button 454, tab 455, slot 466 and spring 468.

Referring to FIG. 22, the spring 468 is extended and pushes locking push button 454 upwards and catch 455 maintains button 454 within rocker switch 400 while fully extended. This position provides a locking mode for the rocker switch 400.

Referring to FIG. 23, the spring 468 is compressed by way of pushing downward on locking push button 454 causing tab 455 to catch within slot 466 and maintains the locking device 450 within rocker switch 400 and therefore allowing for a user to resume using the rocker switch 40 in an unlocked position.

The invention has been described with reference to various specific and illustrative aspects of the present invention and techniques. However, it should be understood that many variations and modifications may be made while remaining within the spirit and scope of the invention. Many alternatives, modifications and variations will be apparent to those skilled in the art in light of the foregoing description. Accordingly, this invention is intended to embrace all such alternatives, modifications, and variations that fall within the spirit and scope of the appended claims.

What is claimed is:

1. A combination rocker switch and locking device for the rocker switch comprising:

a. a rocker switch extending from a switch plate cover, the rocker switch having opposite first and second ends pivotable about a pivot axis between the first and second ends, the rocker switch movable between a first position wherein the first end is substantially flush with a first portion of the switch plate cover and a second position wherein the second end is substantially flush with a second portion of the switch plate cover;

b. a locking device comprising:

i. an elongated member having a top edge, a bottom edge, opposite ends, a front facing surface and a rear facing surface;

ii. a toggle member pivotally mounted to the front facing surface, the toggle member pivotable between a first toggle position that extends below the bottom edge of the elongated member and a second toggle position that does not extend below the bottom edge;

wherein the rear facing surface of the elongated member is mounted to the switch plate cover on the first portion of the switch plate cover, the bottom edge of the elongated member adjacent the first end of the rocker switch, wherein when the first end of the rocker switch is pivoted to the first position and is substantially flush with the first portion of the switch plate cover, the toggle may be pivoted to the first toggle position to extend below the lower edge of the elongated member to overlie the first end of the rocker switch to lock the rocker switch in the first position and the toggle may be pivoted to the second toggle position to unlock the toggle switch from the first position.

2. The combination rocker switch and locking device for the rocker switch of claim 1, wherein the locking device further comprises a pressure sensitive adhesive layer over a portion of the rear facing surface of the elongated member and wherein the rear facing surface of the elongated member is adhesively mounted to the switch plate cover on the first portion of the switch plate cover.

3. The combination rocker switch and locking device for the rocker switch of claim 2, wherein the elongated member has side members extending from each of the ends of the elongated member, each of the side members having front facing and rear facing surfaces coplanar with the front and rear facing surfaces of the elongated member, wherein a pressure sensitive adhesive layer is provided over a portion of the rear facing surface of each side member and wherein the rear facing surface of each side member is adhesively mounted to the switch plate cover.

4. A combination rocker switch and locking device for the rocker switch comprising:

a. a rocker switch extending from a switch plate cover, the rocker switch having opposite first and second ends pivotable about a pivot axis between the first and second ends, the rocker switch movable between a first position wherein the first end is substantially flush with a first portion of the switch plate cover and a second position wherein the second end is substantially flush with a second portion of the switch plate cover, b. a first and second locking device, each comprising:

i. an elongated member having a top edge, a bottom edge, a front facing surface and a rear facing surface;

ii. a toggle member pivotally mounted to the front facing surface, the toggle member pivotable between a first toggle position that extends below the bottom edge of the elongated member and a second toggle position that does not extend below the bottom edge;

wherein the rear facing surface of the elongated member of the first locking device is mounted to the switch plate cover on the first portion of the switch plate cover, the bottom edge of the elongated member adjacent the first end of the rocker switch, wherein the rear facing surface of the elongated member of the second locking device is mounted to the switch plate cover on the second portion of the switch plate cover, the bottom edge of the elongated member adjacent the second end of the rocker switch, wherein when the first end of the rocker switch is pivoted to the first position and is substantially flush with the first portion of the switch plate cover, the toggle on the first locking device may be pivoted to the first toggle position to extend below the lower edge of the elongated member of the first locking device to overlie the first end of the rocker switch to lock the rocker switch in the first position and the toggle may be pivoted to the second toggle position to unlock the rocker switch from the first position; and wherein when the second end of the rocker switch is pivoted to the second position and is substantially flush with the second portion of the switch plate cover, the toggle on the second locking device may be pivoted to the first toggle position to extend below the lower edge of the elongated member of the second locking device to overlie the second end of the rocker switch to lock the toggle switch in the second position and the toggle may be pivoted to the second toggle position to unlock the toggle switch from the second position.

5. The combination rocker switch and locking device for the rocker switch of claim 4, wherein each locking device further comprises a pressure sensitive adhesive layer over a portion of the rear facing surface and wherein the rear facing surface of the elongated member is adhesively mounted to the switch plate cover on the first or second portion of the switch plate cover.

6. The combination rocker switch and locking device for the rocker switch of claim 5, wherein each of the elongated members has side members extending from each of the ends of the elongated members, each side member having front facing and rear facing surfaces coplanar with the front and rear facing surfaces of the elongated member, wherein a pressure sensitive adhesive layer is provided over a portion of the rear facing surface of each side member and wherein the rear facing surface of each side member is adhesively mounted to the switch plate cover.

7. The combination rocker switch and locking device for the rocker switch of claim 6, wherein the elongated members and side members form a unitary structure surrounding the rocker switch adhesively mounted to the switch plate cover.

8. A combination rocker switch and locking device for the rocker switch comprising:

a. a rocker switch extending from a switch plate cover, the rocker switch having opposite first and second ends, the first end having a first end face and the second end having a second end face, wherein the rocker switch is pivotable about a pivot axis between the first and second ends, the rocker switch movable between:

a first position wherein the first end is substantially flush with a first portion of the switch plate cover and the second end and second end face project above the second portion of the switch plate cover, and a second position wherein the second end is substantially flush with the second portion of the switch plate cover and the first end and first end face project above the first portion of the switch plate cover, b. a first locking button having a first button end and a second button end, the first button end mounted within the first end of the rocker switch in the first end face; the first locking button can be selectively positioned to have the second button end project above the first end face or positioned flush with the first end face;

wherein when the first locking button is selectively positioned to have the second button end flush with the first end face, the rocker switch may pivoted to the first position wherein the first end is substantially flush with a first portion of the switch plate cover; and wherein when the rocker switch is pivoted to the second position wherein the second end is substantially flush with the second portion, and the first locking button is selectively positioned in the first end of the rocker switch to have the second button end project above the first end face, the rocker switch is locked in the second position.

9. The combination rocker switch and locking device for the locker switch, comprising:

a. a rocker switch extending from a switch plate cover, the rocker switch having opposite first and second ends, the first end having a first end face and the second end having a second end face, wherein the rocker switch is pivotable about a pivot axis between the first and second ends, the rocker switch movable between:

a first position wherein the first end is substantially flush with a first portion of the switch plate cover and the second end and second end face project above the second portion of the switch plate cover, and a second position wherein the second end is substantially flush with the second portion of the switch plate cover and the first end and first end face project above the first portion of the switch plate cover, b. a first locking button having a first button end and a second button end, the first button end mounted within the first end of the rocker switch in the first end face, the first locking button selectively positioned to have the second button end project above the first end face or positioned flush with the first end face;

c. a second locking button having a first button end and a second button end, the first button end mounted within the second end of the rocker switch in the second end face, the second locking button selectively positioned to have the second button end project above the second end face or positioned flush with the second end face;

wherein when the first locking button is selectively positioned to have the second button end flush with the first end face, the rocker switch may pivoted to the first position wherein the first end is substantially flush with a first portion of the switch plate cover; and wherein when the rocker switch is pivoted to the second position wherein the second end is substantially flush with the second portion, the first locking button may be selectively positioned in the first end of the rocker switch to have the second button end project above the first end face, the rocker switch is locked in the second position, d. wherein when the second locking button is selectively positioned to have the second end flush with the second end face, the rocker switch may pivoted to the second position wherein the second end is substantially flush with the second portion of the switch plate cover;

wherein the first locking button may be selectively positioned in the first end of the rocker switch to have the second button end project above the first end face, locking the rocker switch in the second position;

wherein when the first locking button is selectively positioned to have the second end flush with the second end face, the rocker switch may pivoted to the first position wherein the second end is substantially flush with the second portion of the switch plate cover; and wherein the second locking button may be selectively positioned in the second end of the rocker switch to have the second button end project above the second end face, the rocker switch is locked in the first position.

* * * * *